US005564701A

United States Patent [19]

Dettor

[11] Patent Number: 5,564,701

[45] Date of Patent: Oct. 15, 1996

[54] CASINO ORIENTED GAMING APPARATUS AND METHOD INCORPORATING RANDOMLY GENERATED NUMBERS

[76] Inventor: Michael K. Dettor, 4090 Rio Poco Rd., Reno, Nev. 89502

[21] Appl. No.: 430,466

[22] Filed: Apr. 28, 1995

[51] Int. Cl.$^6$ ..... A63F 3/00

[52] U.S. Cl. ..... 463/16; 273/256; 273/278; 463/6; 463/22

[58] Field of Search ..... 273/144 R, 144 A, 273/144 B, 246, 256, 278, 434, 138 A, 138 R, 85 G

[56] References Cited

U.S. PATENT DOCUMENTS

| | | | |
|---|---|---|---|
| 341,344 | 5/1886 | Nance | 273/144 B |
| 1,583,488 | 5/1926 | Pauer . | |
| 1,628,073 | 5/1927 | Sousa . | |
| 2,010,558 | 8/1935 | Neuzil . | |
| 2,453,290 | 11/1948 | Wetzel . | |
| 3,690,666 | 9/1972 | Seitz . | |
| 4,060,246 | 11/1977 | Ward | 273/246 |
| 4,323,240 | 4/1982 | Stewart et al. | 273/144 A |
| 4,655,461 | 4/1987 | Capri et al. | 273/144 A |
| 4,729,568 | 3/1988 | Welsh | 273/246 |
| 4,840,382 | 6/1989 | Rubin . | |
| 4,874,177 | 10/1989 | Girardin | 273/246 |
| 4,917,386 | 4/1990 | Tozer | 273/246 |
| 5,398,938 | 3/1995 | Money | 273/246 |

*Primary Examiner*—Jessica J. Harrison
*Assistant Examiner*—James Schaaf
*Attorney, Agent, or Firm*—Flehr, Hohbach, Test, Albritton & Herbert

[57] ABSTRACT

A gaming apparatus having at least two competing objects each identified by an associated unique set of identification symbols wherein a game is played by positioning the objects in competition as a function of numbers associated with each object. The gaming apparatus includes a random symbol generator generating a random sequence of the symbols. A computer device calculates an independent incremental value ($I_x$) for each object based on each symbol drawn in the random sequence. Each incremental value ($I_x$) calculated for each object is a function of the identification symbols contained in the associated set, and each determines an independent incremental progression of play of each respective object. The computer device further computes a position value ($M_x$) for each object which is a function of the respective incremental value ($I_x$) for each object, and for each symbol drawn in the random sequence. This position value determines a competing game position relative to any other object.

22 Claims, 7 Drawing Sheets

100 HORSE NAMES - RATING LIST

12

| RATING | NAME | RATING | NAME | RATING | NAME |
|---|---|---|---|---|---|
| 32 | CRYPTIC JEWEL | 26 | BOGUS QUOTA | 20 | BEDAZZLE |
| | FLIMSY EXCUSE | | JOCKEY BOSS | | JAZZ SOLO |
| | PHANTOM VALOR | | RISQUE GIRL | | MONOPOLY |
| 13' | PROFIT MARGIN 13 | | SWING SHIFT | | MUMBO JUMBO |
| | QUICK SHUFFLE | | VIKING WHIM | | SALT AWAY |
| | | | WEDGE ENVOY | | TWEED TUX |
| 31 | BINGO WIZARD | 25 | BANJO WALK | 19 | BETWIXT |
| | CLAIRVOYANT | | JUNKET QUEEN | | BON JOUR |
| | DISCOTHEQUE 13' | | MAGIC WISH | | FAUX PAS |
| | JABBERWOCKY | | QUASI KING | | INQUIRY |
| 12' | ZEPHYR BLITZ 13 | | VELVET VIXEN | | KUMQUAT |
| | | | VODKA CZAR | | TAXI JAM |
| 30 | GALLANT SCAMP | 24 | DEVIL'S JIVE | 18 | CURFEW |
| | KATZENJAMMER | | LUCKY HUNCH | | DEJA VU |
| | SWIZZLE STICK | | MAJOR KAZOO | | LAST LAFF |
| | UGLY DUCKLING | | SHADOW HOAX | | PARALLAX |
| | VICTORY CINCH | | TURF LUXURY | | SHY FOE |
| | | | QUID PRO QUO | | |
| 29 | FUNKY RHYTHM | 23 | BEEF JERKY | 17 | GIN FIZZ |
| | HIGH FALUTIN | | EXCHEQUER | | JU-JIT-SU |
| | MOCK BRAVADO | | JIFFY PICK | | LUMPSUM |
| | PSYCHIC JINX | | KAHLUA JUG | | PAJAMAS |
| | QUIXOTIC JOY | | QUIZZICAL | | WELL OFF |
| | | | VETO POWER | | |
| 28 | DERBY NYMPH | 22 | CHUTZ PAH | 16 | BIG HIT |
| | FLAMBOYANT | | GROOVY GURU | | EZ-COME |
| | NOBLE JUDGE | | KIBITZER | | GYPSY SPY |
| | RENDEZVOUS | | PUPPET EXEC | | LOLLIPOP |
| | SQUEEZE BLUFF | | QUANDARY | | SA-SA-FRAS |
| | TEQUILA MIX | | VERBOTEN | | |
| 27 | BANZAI SAVVY | 21 | HAPHAZARD | 15 | EX-HEXED |
| | BUDGET QUEST | | FOXY PROXY | | FOGGY GO |
| | GALAXY WALTZ | | JUKE BOX | | GRAB BAG |
| | PYRRHIC RISK | | SHOW BIZ | | HOBO BOY |
| | SCREWDRIVER | | WHIRLIGIG | | MADDAMN |
| | SEQUIN PIXIE | | WHIZ KEY | | |

*FIG._3*

11,11',11"

13' 12

SAMPLE RACE RESULTS

| | P | NAME | R | TOTAL | F |
|---|---|---|---|---|---|
| | 1 | SWING SHIFT | 26 | 6.10 | P |
| | 2 | KAHLUA JUG 13 | 23 | 5.23 | |
| | 3 | JABBERWOCKY | 31 | 4.65 | |
| | 4 | FLIMSY EXCUSE | 32 | 4.54 | |
| | 5 | DISCOTHEQUE | 31 | 2.82 | |
| | 6 | DEVIL'S JIVE | 24 | 4.88 | |
| | 7 | GIN FIZZ 13' | 17 | 5.55 | |
| | 8 | BANJO WALK | 25 | 6.09 | S |
| | 9 | UGLY DUCKLING | 30 | 9.07 | W |
| | 10 | GRAB BAG 13 | 15 | 4.04 | |
| 2 | 1 | VERBOTEN | 22 | 7.54 | W |
| | 2 | RISQUE GIRL | 26 | 2.52 | |
| 12' | 3 | BINGO WIZARD | 31 | 5.67 | P |
| | 4 | BETWIXT | 19 | 4.09 | |
| | 5 | JU-JIT-SU | 17 | 2.36 | |
| | 6 | SCREWDRIVER | 27 | 4.39 | |
| | 7 | EZ-COME | 16 | 1.75 | |
| | 8 | CURFEW | 18 | 4.47 | S |
| | 9 | TAXI JAM | 19 | 2.78 | |
| | 10 | SHADOW HOAX | 24 | 2.68 | |
| 3 | 1 | GROOVY GURU | 22 | 4.29 | |
| | 2 | HIGH FALUTIN | 29 | 6.76 | S |
| | 3 | FOXY PROXY | 21 | 3.89 | |
| | 4 | FLAMBOYANT | 28 | 3.21 | |
| | 5 | PYRRHIC RISK | 27 | 7.60 | W |
| | 6 | JUNKET QUEEN | 25 | 7.23 | P |
| | 7 | GALAXY WALTZ | 27 | 3.72 | |
| | 8 | MUMBO JUMBO | 20 | 2.73 | |
| | 9 | JOCKEY BOSS | 26 | 4.10 | |
| | 10 | BIG HIT | 16 | 3.69 | |
| 4 | 1 | CHUTZ PAH | 22 | 5.59 | |
| | 2 | WHIZ KEY | 21 | 6.57 | |
| | 3 | LOLLIPOP | 16 | 3.42 | |
| | 4 | QUASI KING | 25 | 2.67 | |
| | 5 | WEDGE ENVOY | 26 | 7.20 | S |
| | 6 | QUICK SHUFFLE | 32 | 8.09 | P |
| | 7 | GYPSY SPY | 16 | 4.19 | |
| | 8 | RENDEZVOUS | 28 | 8.97 | W |
| | 9 | BEEF JERKY | 23 | 6.30 | |
| | 10 | BON JOUR | 19 | 2.50 | |
| 5 | 1 | CRYPTIC JEWEL | 32 | 8.88 | P |
| | 2 | ZEPHER BLITZ | 31 | 7.27 | |
| | 3 | VETO POWER | 23 | 6.13 | |
| | 4 | GALLANT SCAMP | 30 | 4.47 | |
| | 5 | CLAIRVOYANT | 31 | 8.19 | S |
| | 6 | PHANTOM VALOR | 32 | 10.12 | W |
| | 7 | BOGUS QUOTA | 26 | 4.07 | |
| | 8 | PUPPET EXEC | 22 | 5.49 | |
| | 9 | KUMQUAT | 19 | 3.54 | |
| | 10 | JAZZ SOLO | 20 | 3.77 | |

| | P | NAME | R | TOTAL | F |
|---|---|---|---|---|---|
| 6 | 1 | MONOPOLY | 20 | 5.15 | W |
| | 2 | LAST LAFF | 18 | 3.23 | |
| | 3 | HOBO BOY | 15 | 4.65 | P |
| | 4 | QUANDARY | 22 | 3.90 | |
| | 5 | TWEED TUX | 20 | 3.94 | |
| | 6 | SA-SA-FRAS | 16 | 2.72 | |
| | 7 | KATZENJAMMER | 30 | 4.15 | S |
| | 8 | VICTORY CINCH | 30 | 3.86 | |
| | 9 | MAGIC WISH | 25 | 3.98 | |
| | 10 | JIFFY PICK | 23 | 3.64 | |
| 7 | 1 | WELL OFF | 17 | 4.37 | |
| | 2 | PROFIT MARGIN | 32 | 2.96 | |
| | 3 | JUKE BOX | 21 | 9.30 | W |
| | 4 | LUMPSUM | 17 | 3.43 | |
| | 5 | TEQUILA MIX | 28 | 6.08 | |
| | 6 | QUID PRO QUO | 24 | 2.74 | |
| | 7 | QUIXOTIC JOY | 29 | 7.25 | P |
| | 8 | FUNKY RHYTHM | 29 | 4.56 | |
| | 9 | MADDAMN | 15 | 1.90 | |
| | 10 | MAJOR KAZOO | 24 | 6.76 | S |
| 8 | 1 | SEQUIN PIXIE | 27 | 2.49 | |
| | 2 | SHY FOE | 18 | 1.32 | |
| | 3 | SQUEEZE BLUFF | 28 | 3.36 | |
| | 4 | DEJA VU | 18 | 4.11 | |
| | 5 | HAPHAZARD | 21 | 5.55 | S |
| | 6 | INQUIRY | 19 | 4.92 | |
| | 7 | SHOW BIZ | 21 | 3.84 | |
| | 8 | KIBITZER | 22 | 6.69 | P |
| | 9 | TURF LUXURY | 24 | 4.70 | |
| | 10 | VODKA CZAR | 25 | 10.47 | W |
| 9 | 1 | SALT AWAY | 20 | 3.59 | |
| | 2 | BUDGET QUEST | 27 | 3.99 | |
| | 3 | SWIZZLE STICK | 30 | 1.41 | |
| | 4 | EX-HEXED | 15 | 4.33 | |
| | 5 | VELVET VIXEN | 25 | 4.59 | |
| | 6 | WHIRLIGIG | 21 | 6.13 | P |
| | 7 | BEDAZZLE | 20 | 1.89 | |
| | 8 | FOGGY GO | 15 | 8.28 | W |
| | 9 | LUCKY HUNCH | 24 | 2.49 | |
| | 10 | FAUX PAS | 19 | 4.75 | S |
| 10 | 1 | MOCK BRAVADO | 29 | 4.65 | |
| | 2 | DERBY NYMPH | 28 | 6.30 | W |
| | 3 | EXCHEQUER | 23 | 5.83 | P |
| | 4 | NOBLE JUDGE | 28 | 5.63 | S |
| | 5 | BANZAI SAVVY | 27 | 2.87 | |
| | 6 | PAJAMAS | 17 | 3.50 | |
| | 7 | PSYCHIC JINX | 29 | 5.63 | * |
| | 8 | QUIZZICAL | 23 | 2.94 | |
| | 9 | PARALLAX | 18 | 3.80 | |
| | 10 | VIKING WHIM | 26 | 5.61 | |

FIG._4

11,11',11"

12

THE SLOT MARKET : 100 STOCK SYMBOLS

| | | | | | | | | | |
|---|---|---|---|---|---|---|---|---|---|
| 00 | ABC | 20 | FGL | 40 | KDG | 60 | PAY | 80 | UJI |
| 01 | AHI | 21 | FHO | 41 | KEY | 61 | PCL | 81 | UNF |
| 02 | ASK | 22 | FJE | 42 | KLW | 62 | PFD | 82 | UPR |
| 03 | AWU | 23 | FWX | 43 | KQV | 63 | PQX | 83 | UVE |
| 04 | BET | 24 | GBR | 44 | LHU | 64 | QEA | 84 | VAL |
| 05 | BID | 25 | GNA | 45 | LQB | 65 | QFI | 85 | VBO |
| 06 | BKN | 26 | GPZ | 46 | LTD | 66 | QUO | 86 | VSW |
| 07 | BUY | 27 | GVJ | 47 | LZM | 67 | QWG | 87 | VXR |
| 08 | CDR | 28 | HDE | 48 | MAX | 68 | RKH | 88 | WHC |
| 09 | CKF | 29 | HJQ | 49 | MCV | 69 | RQS | 89 | WMI |
| 10 | CQZ | 30 | HMB | 50 | MFR | 70 | RTN | 90 | WPB |
| 11 | CTU | 31 | HVN | 51 | MNY | 71 | RZJ | 91 | XKI |
| 12 | DJA | 32 | IGT | 52 | NDQ | 72 | SCG | 92 | XSD |
| 13 | DMU | 33 | ILY | 53 | NLX | 73 | SEL | 93 | XYZ |
| 14 | DOW | 34 | INC | 54 | NPE | 74 | SJN | 94 | YGH |
| 15 | DVZ | 35 | IPO | 55 | NWZ | 75 | SPH | 95 | YRW |
| 16 | EMG | 36 | JKM | 56 | OGX | 76 | TFA | 96 | YSO |
| 17 | ERI | 37 | JPT | 57 | OLJ | 77 | THZ | 97 | ZFB |
| 18 | EXC | 38 | JXB | 58 | ORA | 78 | TSM | 98 | ZKU |
| 19 | EZO | 39 | JYC | 59 | OTK | 79 | TVY | 99 | ZSI |

13 13' 13' 13

12'

*FIG._6*

THE SLOT MARKET: GAME SIMULATION - EARNINGS

| LTR | CODE | @100 | @200 | @300 | @400 | @500 | @600 | @700 | @800 | @900 | GAME |
|---|---|---|---|---|---|---|---|---|---|---|---|
| A | 00-02 | 420 | 440 | 440 | 440 | 440 | 620 | 640 | 640 | 640 | 640 |
| B | 03-05 | 260 | 260 | 260 | 260 | 280 | 360 | 360 | 360 | 680 | 680 |
| C | 06-08 | 0 | 180 | 260 | 260 | 260 | 260 | 260 | 260 | 260 | 600 |
| D | 09-11 | 0 | 40 | 60 | 60 | 220 | 220 | 280 | 420 | 480 | 540 |
| E | 12-14 | 0 | 0 | 0 | 0 | 0 | 0 | 0 | 260 | 260 | 260 |
| F | 15-17 | 0 | 0 | 0 | 0 | 0 | 160 | 260 | 260 | 360 | 360 |
| G | 18-20 | 100 | 120 | 120 | 120 | 140 | 300 | 460 | 460 | 460 | 460 |
| H | 21-23 | 0 | 0 | 40 | 40 | 40 | 380 | 380 | 380 | 380 | 380 |
| I | 24-26 | 0 | 340 | 340 | 360 | 400 | 760 | 840 | 940 | 980 | 1300 |
| J | 27-29 | 0 | 0 | 40 | 40 | 40 | 40 | 200 | 200 | 300 | 300 |
| K | 30-32 | 40 | 40 | 40 | 200 | 200 | 280 | 420 | 960 | 960 | 1240 |
| L | 33-35 | 100 | 380 | 580 | 860 | 940 | 1020 | 1020 | 1140 | 1220 | 1220 |
| M | 36-38 | 20 | 100 | 180 | 180 | 180 | 220 | 220 | 220 | 220 | 220 |
| N | 39-41 | 0 | 100 | 180 | 180 | 180 | 180 | 180 | 240 | 240 | 240 |
| O | 42-44 | 140 | 180 | 360 | 440 | 580 | 580 | 580 | 580 | 580 | 580 |
| P | 45-47 | 80 | 80 | 80 | 100 | 100 | 120 | 140 | 300 | 520 | 520 |
| Q | 48-50 | 0 | 0 | 0 | 60 | 160 | 180 | 360 | 460 | 540 | 540 |
| R | 51-53 | 0 | 0 | 0 | 0 | 0 | 40 | 80 | 80 | 140 | 440 |
| S | 54-56 | 80 | 100 | 260 | 460 | 460 | 460 | 460 | 460 | 540 | 540 |
| T | 57-59 | 0 | 0 | 100 | 120 | 500 | 500 | 940 | 1000 | 1120 | 1640 |
| U | 60-62 | 0 | 0 | 0 | 20 | 320 | 320 | 320 | 320 | 480 | 480 |
| V | 63-65 | 120 | 120 | 500 | 700 | 700 | 700 | 700 | 700 | 700 | 700 |
| W | 66-68 | 0 | 0 | 60 | 320 | 320 | 320 | 320 | 320 | 360 | 360 |
| X | 69-71 | 0 | 0 | 360 | 520 | 660 | 660 | 660 | 660 | 660 | 780 |
| Y | 72-74 | 60 | 320 | 380 | 420 | 420 | 600 | 720 | 920 | 920 | 920 |
| Z | 75-77 | 0 | 0 | 0 | 0 | 0 | 0 | 0 | 0 | 0 | 0 |
| | | | | | | | | | | TOTAL | 15940 |

*FIG._7*

12

THE SLOT MARKET: GAME SIMULATION - SUMMARY

13'

| NO | STK | STOCK VALUE | NO. SH | SHARE HLDRS | SHARE VALUE | NO | STK | STOCK VALUE | NO. SH | SHARE HLDRS | SHARE VALUE |
|---|---|---|---|---|---|---|---|---|---|---|---|
| 00 | ABC | 1920 | 41 | 10 | 46.83 | 50 | MFR | 1020 | 68 | 15 | 15.00 |
| 01 | AHI | 2320 | 52 | 8 | 44.62 | 51 | MNY | 1380 | 39 | 9 | 35.38 |
| 02 | ASK | 2420 | 17 | 4 | 142.35 | 52 | NDQ | 1320 | 52 | 13 | 25.38 |
| 03 | AWU | 1480 | 56 | 14 | 26.43 | 53 | NLX | 2240 | 58 | 17* | 38.62 |
| 04 | BET | 2580 | 22 | 8 | 117.27 | 54 | NPE | 1020 | 24 | 7 | 42.50 |
| 05 | BID | 2520 | 41 | 13 | 61.46 | 55 | NWZ | 600* | 57 | 12 | 10.53* |
| 06 | BKN | 2160 | 37 | 10 | 58.38 | 56 | OGX | 1820 | 59 | 16 | 30.85 |
| 07 | BUY | 2080 | 35 | 12 | 59.43 | 57 | OLJ | 2100 | 37 | 10 | 56.76 |
| 08 | CDR | 1580 | 16 | 6 | 98.75 | 58 | ORA | 1660 | 33 | 11 | 50.30 |
| 09 | CKF | 2200 | 53 | 13 | 41.51 | 59 | OTK | 3460* | 34 | 8 | 101.76 |
| 10 | CQZ | 1140 | 50 | 13 | 22.80 | 60 | PAY | 2080 | 77 | 14 | 27.01 |
| 11 | CTU | 2720 | 70 | 15 | 38.86 | 61 | PCL | 2340 | 61 | 11 | 38.36 |
| 12 | DJA | 1480 | 56 | 11 | 26.43 | 62 | PFD | 1420 | 49 | 13 | 28.98 |
| 13 | DMU | 1240 | 59 | 16 | 27.56 | 63 | PQX | 1840 | 38 | 11 | 48.42 |
| 14 | DOW | 1480 | 45 | 12 | 32.89 | 64 | QEA | 1440 | 37 | 10 | 38.92 |
| 15 | DVZ | 1240 | 44 | 11 | 28.18 | 65 | QFI | 2200 | 41 | 9 | 53.66 |
| 16 | EMG | 940 | 43 | 11 | 21.86 | 66 | QUO | 1600 | 32 | 10 | 50.00 |
| 17 | ERI | 2000 | 45 | 10 | 44.44 | 67 | QWG | 1360 | 36 | 9 | 37.78 |
| 18 | EXC | 1640 | 25 | 8 | 65.60 | 68 | RKH | 2060 | 26 | 6 | 79.23 |
| 19 | EZO | 840 | 50 | 12 | 16.80 | 69 | RQS | 1520 | 33 | 9 | 46.06 |
| 20 | FGL | 2040 | 37 | 8 | 55.14 | 70 | RTN | 2320 | 39 | 10 | 59.49 |
| 21 | FHO | 1320 | 51 | 13 | 25.88 | 71 | RZJ | 740 | 42 | 9 | 17.62 |
| 22 | FJE | 920 | 26 | 6 | 35.38 | 72 | SCG | 1600 | 18 | 5 | 88.89 |
| 23 | FWX | 1500 | 35 | 10 | 42.86 | 73 | SEL | 2020 | 36 | 10 | 56.11 |
| 24 | GBR | 1580 | 55 | 14 | 28.73 | 74 | SJN | 1080 | 27 | 6 | 40.00 |
| 25 | GNA | 1340 | 32 | 8 | 41.88 | 75 | SPH | 1440 | 64 | 15 | 22.50 |
| 26 | GPZ | 980 | 8* | 2* | 122.50 | 76 | TFA | 2640 | 23 | 9 | 114.78 |
| 27 | GVJ | 1460 | 21 | 5 | 69.52 | 77 | THZ | 2020 | 61 | 12 | 33.11 |
| 28 | HDE | 1180 | 24 | 8 | 49.17 | **78** | **TSM** | **2400** | **35** | **10** | **68.57** |
| 29 | HJQ | 1220 | 44 | 11 | 27.73 | 79 | TVY | 3260 | 63 | 16 | 51.75 |
| 30 | HMB | 1280 | 37 | 8 | 34.59 | 80 | UJI | 2080 | 33 | 6 | 63.03 |
| 31 | HVN | 1320 | 13 | 5 | 101.54 | 81 | UNF | 1080 | 39 | 11 | 27.69 |
| 32 | IGT | 3400 | 56 | 15 | 60.71 | 82 | UPR | 1440 | 40 | 7 | 36.00 |
| 33 | ILY | 3440 | 42 | 12 | 81.90 | 83 | UVE | 1440 | 33 | 9 | 43.64 |
| 34 | INC | 2140 | 31 | 9 | 69.03 | 84 | VAL | 2560 | 38 | 13 | 67.37 |
| 35 | IPO | 2400 | 32 | 9 | 75.00 | 85 | VBO | 1960 | 56 | 13 | 35.00 |
| 36 | JKM | 1760 | 17 | 4 | 103.53 | 86 | VSW | 1600 | 30 | 9 | 53.33 |
| 37 | JPT | 2460 | 56 | 15 | 43.93 | 87 | VXR | 1920 | 53 | 16 | 36.23 |
| 38 | JXB | 1760 | 21 | 7 | 83.81 | 88 | WHC | 1340 | 47 | 11 | 28.51 |
| 39 | JYC | 1820 | 35 | 10 | 52.00 | 89 | WMI | 1880 | 38 | 10 | 49.47 |
| 40 | KDG | 2240 | 36 | 13 | 62.22 | 90 | WPB | 1560 | 29 | 7 | 53.79 |
| 41 | KEY | 2420 | 25 | 7 | 96.80 | 91 | XKI | 3320 | 29 | 9 | 114.48 |
| 42 | KLW | 2820 | 63 | 12 | 44.76 | 92 | XSD | 1860 | 39 | 8 | 47.69 |
| 43 | KQV | 2480 | 48 | 11 | 51.67 | 93 | XYZ | 1700 | 22 | 4 | 77.27 |
| 44 | LHU | 2080 | 59 | 11 | 35.25 | 94 | YGH | 1760 | 25 | 8 | 70.40 |
| 45 | LQB | 2440 | 38 | 9 | 64.21 | 95 | YRW | 1720 | 23 | 6 | 74.78 |
| 46 | LTD | 3400 | 21 | 7 | 161.90* | 96 | YSO | 2040 | 39 | 11 | 52.31 |
| 47 | LZM | 1440 | 51 | 11 | 28.24 | 97 | ZFB | 1040 | 40 | 10 | 26.00 |
| 48 | MAX | 1640 | 16 | 6 | 102.50 | 98 | ZKU | 1720 | 78* | 15 | 22.05 |
| 49 | MCV | 1520 | 20 | 6 | 76.00 | 99 | ZSI | 1840 | 31 | 9 | 59.35 |

13 13' 12'

11,11',11"

FIG._8

CASINO ORIENTED GAMING APPARATUS AND METHOD INCORPORATING RANDOMLY GENERATED NUMBERS

TECHNICAL FIELD

The present invention relates, generally, to casino-type games and, more particularly, relates to electronic casino oriented games involving the progression of play as determined by the generation of random numbers.

BACKGROUND ART

Many casino gambling games rely upon the random occurrence of events to determine the outcome of play of one or more individuals. These random events are frequently generated through the rolling of dice, and the sequential drawing of shuffled cards.

Technological advances, especially in the electronic arts, have enabled the development and commercialization of numerous electronic video-type casino gambling games which are computer or microprocessor based. These electronic games often employ a random number generator program to generate number sequences that are applied to a series of events. In turn, a random occurrence of events is provided.

Some electronic casino gambling games are designed for only one player competing against the computer or "house". These games typically include card games which generate random numbers to determine card values. Depending upon the random cards values generated, the player can then determine play of the game. Accordingly, some player strategy and interaction is required to determine play of the game. Typical of these electronic games include video "Poker" or video "Blackjack".

Other casino games, offering multiple player participation, provide a selection of competing objects which can be bet on by one or more players concurrently prior to each betting round. These games, both electronic and conventional, incorporate various random generations devices or methods to determine the relative value or outcome of the objects. One advantage of multiple player gaming is that pari-mutuel style betting with variable competing objects is possible. However, existing multiple player casino games, including such games as Keno, roulette, craps, etc., are typically based on a fixed set of objects (e.g., specific numbers, "red", "black", etc.) with predetermined probabilities and pay-off amounts. Hence, selection of competing objects and payout expectations do not vary from round to round which would require participants to vary their betting strategies and enhance gambling interests.

Board type games involving multiple players have been developed which incorporate both game playing strategy and random number generation to determine play and hence the outcome of games. Typical of these patented games include U.S. Pat. No. 4,840,382 (a financial asset game) and U.S. Pat. No. 3,690,666 (a horse racing game). For example, the performance of each stock in the financial asset game is to some extent dependent upon certain market trends affecting a particular stock, as well as the stocks relationship to that market trend. In the horse racing game, the performance of the selected horse depends upon the track conditions, the jockey's ability, and the past performance of the horses to determine the race results.

While the outcome of these patented games are to some extent dependent upon the particular competing object selected, too much strategy and examination are required for casino-type gambling games. Such extensive strategy would severely reduce revenue for the gambling establishment due to the time consumption required by the players in their choice of a competing object.

DISCLOSURE OF INVENTION

Accordingly, it is an object of the present invention to provide a casino gambling apparatus and method which incorporates random number generation to determine the outcome of the game.

Another object of the present invention is to provide a casino gambling apparatus and method which enables multiple players to participate in pari-mutuel style betting.

Still another object of the present invention is to provide a casino gambling apparatus and method in which the probabilities and payout expectations for a game or round are a function of the objects placed in competition and the placement of bets on the competing objects by the players.

Yet another object of the present invention is to provide a gaming concept which is suitable of use in a number of gambling games employing random number generation.

It is a further object of the present invention to provide a casino gambling apparatus and method which is easy to use by unskilled participants.

In accordance with the foregoing objects, the present invention provides a gaming apparatus having at least two competing objects each identified by an associated unique set of identification symbols wherein a game is played by positioning the objects in competition as a function of numbers associated with each object. The gaming apparatus includes a random symbol generator drawing a random sequence of at least two (2) of the symbols of the associated unique sets of the identification symbols. A computer device calculates an independent incremental value ($I_x$) for each object based on each symbol drawn in the random sequence. Each incremental value ($I_x$) calculated for each object is a function of the identification symbols contained in the associated set, and each determines an independent incremental progression of play of each respective object. The computer device further computes a position value ($M_x$) for each object which is a function of the respective incremental value ($I_x$) for each object, and for each symbol drawn in the random sequence. This position value determines a competing game position relative to any other object. Further included is an object indicator for each object indicating the relative corresponding position value ($M_x$) thereof.

In another aspect of the present invention, a method of determining the play of a gaming apparatus is provided having at least two competing objects wherein a game is played by positioning the objects in competition as a function of numbers associated with each object. The gaming apparatus includes a number generator, and a computer, which are all intercoupled for communication.

The method comprises the steps of: (A) assigning to each object an associated unique set of identification symbols; (B) generating, by the symbol generator, a random sequence of at least two (2) of the symbols from the associated unique sets of the identification symbols; and (C) calculating with the computer an incremental value ($I_x$) for each object based on each identification symbol drawn in the random sequence of step (B). Each incremental value ($I_x$) for each object is a function of the identification symbols contained in the respective associated set, and determines an independent incremental progression of play of each respective object. The next step of the present invention includes (D) computing with the computer a position value ($M_x$) for each object based on each symbol drawn in the random sequence of step (B) as a function of the respective incremental value ($I_x$) to determine a competing game position relative to any other object; and (E) changing an object indicator for each object a proportional amount corresponding to the relative position value ($M_x$) thereof.

BRIEF DESCRIPTION OF THE DRAWING

The assembly of the present invention has other objects and features of advantage which will be more readily apparent from the following description of the best mode of carrying out the invention and the appended claims, when taken in conjunction with the accompanying drawing, in which:

FIG. 3 is a "move rating" list of the competing object horses for the game of FIG. 2 which are based upon the set of letters of their corresponding names.

FIG. 4 is a table of the summary of ten simulated horse racing games for the game of FIG. 2.

FIG. 6 is a list of the competing object stocks each identified by a unique three letter symbol set for the game of FIG. 5.

FIG. 7 is a table of the summary of the accumulated value of each letter for the game of FIG. 5 at each centennial iteration.

FIG. 8 is a table of the summary of the accumulated value of each stock after the one thousandth iteration for the game of FIG. 5.

BEST MODE OF CARRYING OUT THE INVENTION

Figure 1:
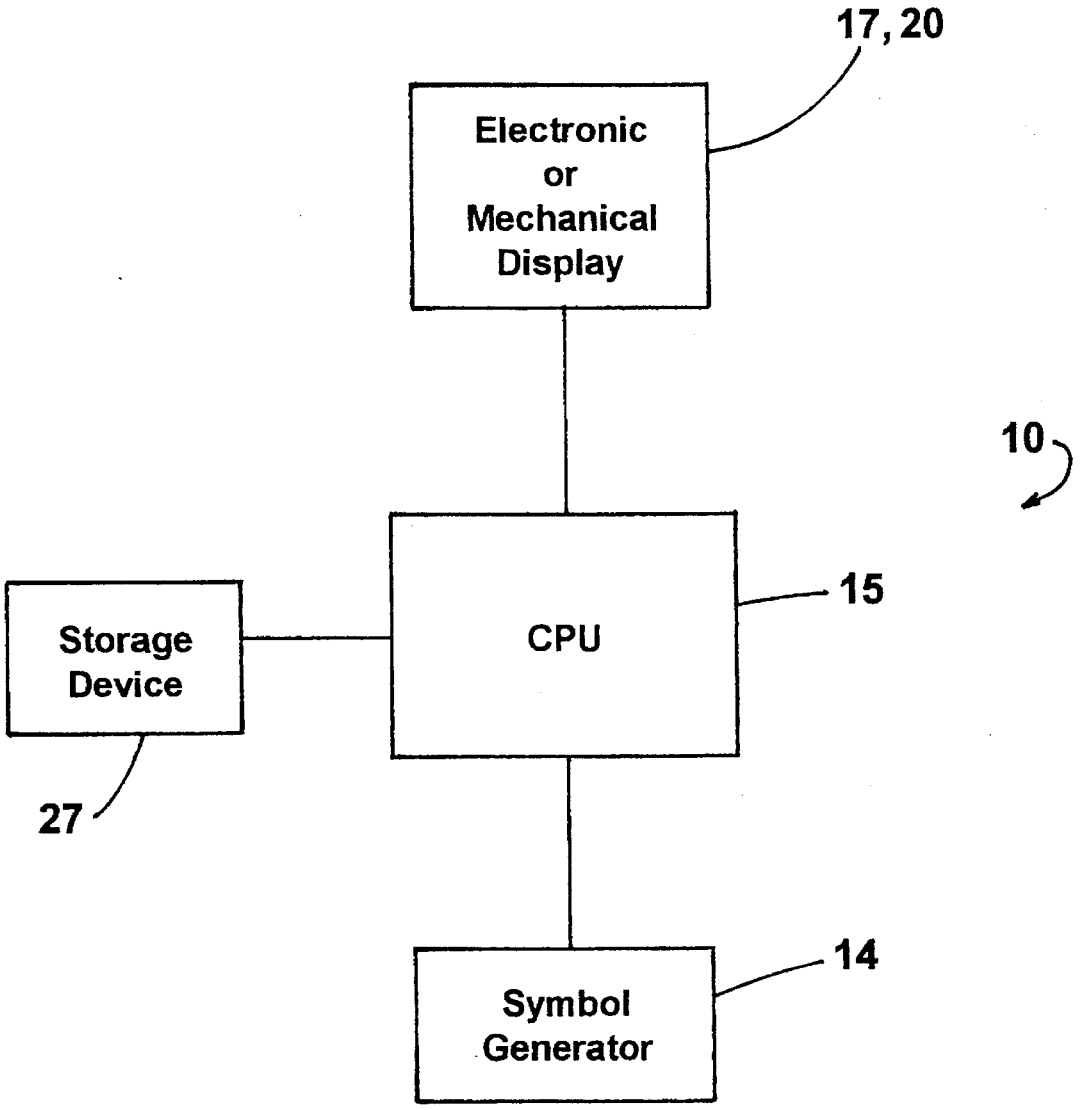
FIG. 1 is a schematic diagram illustrating the method and operational concepts of the casino gambling game of the present invention.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Figure 2:
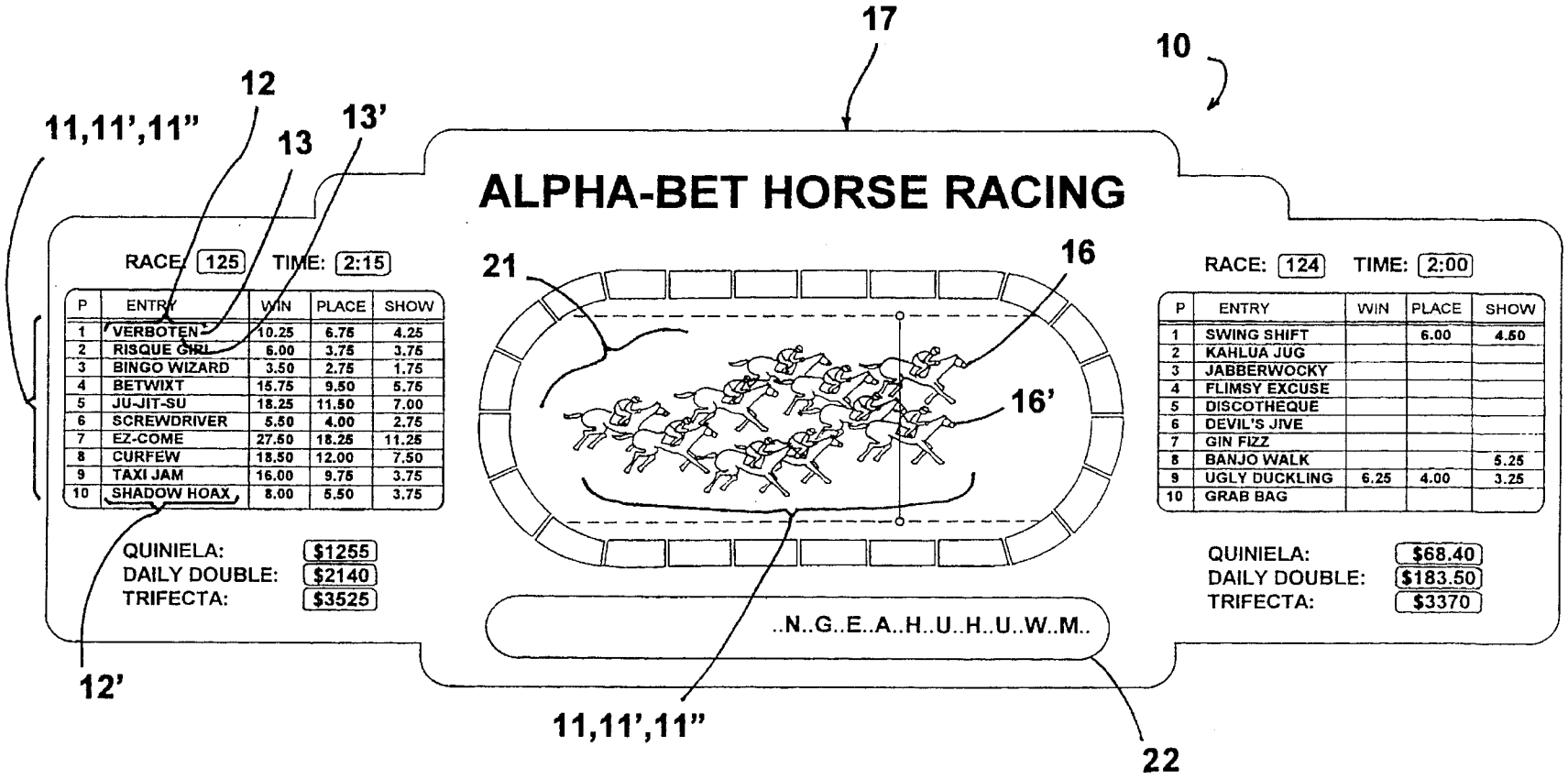
FIG. 2 is a front elevation view of a display board of a horse racing game embodiment incorporating the concept of the present invention.

Attention is now directed to FIG. 1 where a schematic diagram is shown of the casino oriented gambling game of the present invention, and FIG. 2 illustrating an example game incorporating the present invention. In accordance with the foregoing objects, the present invention provides a gaming apparatus, generally designated 10, having at least two competing objects 11, 11', 11" etc. (hereinafter only two objects and associated elements will be referenced), each object being identified by an associated unique set 12, 12' of identification symbols 13, 13' wherein a game is played by positioning objects 11, 11' in competition as a function of numbers associated with each object. Gaming apparatus 10 includes a random symbol generator 14 generating a random sequence of the symbols of the associated unique sets of the identification symbols, and a computer device, generally designated 15, which calculates an independent incremental value ($I_x$) (FIG. 1) for each object based on each identification symbol drawn in the random sequence. Each incremental value ($I_x$) for each object is a function of the identification symbol contained in the associated set, and determines an independent incremental progression of play of the respective object. Computer device 15 further computes a position value ($M_x$) (FIG. 1) for each competing object 11, 11' and for each symbol drawn in the random sequence as a function of the respective incremental value ($I_x$) to determine a competing game position relative to any other object. Further included is an object indicator, generally designated 16, 16' (FIG. 5), for each object 11, 11' indicating the relative corresponding position value ($M_x$) thereof.

Accordingly, the present invention provides a novel approach to the random relative movement or value adjustment of the individual competing objects in a casino gambling game. Based upon the set of identification symbols associated with a particular object, and the sequence upon which those symbols (if at all) are randomly drawn, the movement or value adjustment can be determined. The casino gaming concept of the present invention may be applied or incorporated into a plurality of different games, to be described below, where multiple competing objects are randomly moved or value-adjusted relative to one another until a selected competing object is deemed the winner in accordance with a predetermined set of rules. The present invention, moveover, is particularly suitable for pari-mutuel style betting schemes and electronic networking which can expand the diversity of casino gaming. Hence, the increased excitement and dynamics of multiple player participation is offered.

Depending on the game, the competing objects may be either predetermined or randomly designated to the participants before the individual games commence. Subsequently, symbol generator 14 will randomly generate or draw at least two (2), but generally at least eight (8), symbols sequentially from a predetermined list of symbols during the course of a game or at least one round of a game. As mentioned, each competing object 11, 11' is identified by a unique set 12, 12' of identification symbols from that list. It will be appreciated that each symbol set identifying a particular object may include more than one of a particular symbol. Further, as will be described below, a symbol from the list may be generated at any given iteration which is not included in any of the symbol sets of the selected competing objects in that particular game.

In the preferred form, the identification symbols are provided by letters of the alphabet where each unique symbol set generally spells a word, such as a personal pronoun, pronoun, etc., or an acronym. It will be understood, however, that the symbol set may have no particular significance.

Upon random draw or random sequencing of a letter in one iteration, such as "P", all competing objects including one or more of the letter "P" in its designated symbol set would be value-adjusted or moved by an amount equivalent to the incremental numerical value ($I_x$), a function of the letter or letters "P". It will be appreciated that any set of symbols other than letters may be employed to designate and identify an object without departing from the true spirit and nature of the present invention.

In accordance with the present invention, the value or magnitude of this incremental value ($I_x$) is a function of the symbol itself, and in some instances the function or sequence in which these symbols are randomly drawn by symbol generator 14. Incremental value ($I_x$), for each object after a particular symbol has been randomly drawn, is calculated by computer or central processing unit (CPU) 15 in accordance with a first predetermined equation for each computation. This equation may be a function of a fixed or multiple numerical increments (including randomly assigned numerical values), of the numerical value assigned the particular letter drawn, of the number of equivalent letters in the particular symbol set, of the individual sets of identification symbols for each object, or a combination thereof. As an example, every third letter of the alphabet (i.e., a, d, g, . . . , y) may be assigned the value 1; the second group (i.e., b, e, h, . . . , z) may be assigned the value 2; while the third group of letters (i.e., c, f, i, . . . , x) may be assigned the value 3.

Moreover, the predetermined first equation may be a function of the sequence in which the individual symbols were randomly drawn from the generator, or the accumulation of prior independent incremental values in the sequence ($I_1$, . . . , $I_x$) to determine incremental movement of the individual objects. For instance, the first equation for calculating the incremental value ($I_x$) may be equivalent to:

$$I_x=(L)(n)(S)$$

where,

L=the numerical value assigned the drawn letter;

n=the number of letters in a particular symbol set; and

S=the sequence number of the letter drawn.

Should symbol generator 14 randomly draw the four letter sequence "E", "P", "N" and "R", the incremental values ($I_1$, . . . , $I_4$) for the identification symbol set "RUNNER" may be calculated as follows, where the above-mentioned numerical value designation (L) is employed:

$I_1$=(2) (1) (1)=2 (i.e., L=2; n=1 and S=1);

$I_2$=(1) (0) (2)=0 (i.e., L=1; n=0 and S=2);

$I_3$=(2) (2) (3)=12 (i.e., L=2; n=2 and S=3); and $I_4$=(3) (1) (4)=12 (i.e., L=3; n=1 and S=4).

Accordingly, the first equation can be formulated to yield incremental results appropriate for a particular game. This procedure or calculation is to be performed for each object, after each random symbol draw.

As above-mentioned, the position value ($M_x$) represents the accumulation or sequence of the independent incremental values ($I_1$, . . . , $I_x$) which determines the total play of each object 11, 11' relative to any other object. In the preferred embodiment, position value ($M_x$) is a function of the respective sequence of incremental values ($I_1$, . . . , $I_x$) for each object, and is calculated in accordance with a predetermined second equation. Using the previous example, and a simple summation for the predetermined second equation, $M_x=I_1+I_2+I_3+I_4$, or $M_{x-1}+I_4=26$. Hence, each subsequent position value ($M_{x+1}$) for each object either progresses or regresses (if ($I_{x+1}$) is negative) the previous respective position value ($M_x$) by a function of the corresponding incremental value ($I_x$).

The CPU 15 is preferably electrically coupled to the object indicators 16, 16' for each object 11, 11' to indicate the competing game position relative to the other objects. Accordingly, depending upon the game, the object indicators are either physically or electronically advancing or withdrawing (e.g., the horse figurines or video images in the horse racing game illustrated in FIG. 2), or are valued adjusted (e.g., the stock values in the stock market game illustrated in FIG. 5) through electronic means. For example, if the object indicators 16, 16' of individual competing objects 11, 11' are provided by horses (FIG. 2) in a race, an electronic display 17 displaying video images of the horses or mechanical moving mechanism may be provided indicating the physical advancement of each horse relative to competing positions (i.e., a function of the position value ($M_x$)). As another example, if the individual competing objects are provided by individual stocks 11, 11' (FIG. 5), the object indicators 16, 16' corresponding to the stocks value or position value ($M_x$) are represented by an electronic display 20 indicating the dollar value of each stock relative to one another, rather than an actual physical positioning thereof. These displays, hence, may be provided by vertically displayed, networked video screens.

To better understand and define the present invention, attention is now directed to Example 1, and FIGS. 2–4, where the above-mentioned gaming concept is incorporated.

EXAMPLE 1

This first game represents a simulated horse racing game incorporating the concept of the present invention which incrementally moves the horses (i.e., the competing objects 11, 11') based upon the letters in their assigned names, and on the random draw of letters through random symbol generator 14 (FIG. 1).

As shown in FIG. 2, an example display 17 is illustrated for use in a casino-type game. This game preferably offers pari-mutuel style betting including various betting options such as, win, place, show, quinielas, daily doubles and trifectas.

The probabilities of a horse to win, place or show vary according to the letters (identification symbols) in the name of the particular horse, the strength of the field entered, and the number and sequence of the letters drawn. To assist betting strategy, the "move rating" for each horse, based upon the unique set of identification symbols (i.e., names) assigned to the horses, could be provided to the participants. With pari-mutuel play, the pay-off odds on the various bets would be continually adjusted according to the amounts wagered by the participants up until the start of each race.

In the preferred form of this example, ten entries are selected randomly by the computer from a preselected list of available entries whereby the participants may select one or more (if placing multiple bets) of those ten entries before the beginning of the game. As is normally the situation with actual horse racing, selection of a particular horse is based upon the horse's probability of winning in combination with the pay-off odds provided for a particular race. In the present invention, the probabilities of a horse to win is a function of the letters contained in the name of the horse. For example, a move value (not to be confused with incremental value ($I_x$)) of three (3) may be assigned to each letter the first time that letter appears in a particular horses name, while a value of one (1) may be assigned for each repeat letter. This equation for each letter may be represented by:

$$L=3+(n-1),$$

where n=the number of times the particular letter appears in the name.

Accordingly, should a horse be assigned the name "JUNKET QUEEN", the move rating may be calculated as follows: letters J, K, T and Q would all carry a value of three (3); N and U, of which there are two each, would each carry a value of four (4); while E, of which there is three, would calculate to a numerical value of five (5). Through summation, the symbol set "JUNKET QUEEN" would have a move rating equal to:

$$MR=L_J+L_K+L_T+L_Q+L_N+L_U+L_E=25.$$

FIG. 3 illustrates other potential entries having move ratings ranging from a minimum of fifteen (15) to a maximum of thirty-two (32). This range provides a reasonable degree of competition between the symbol sets based on the preferred number of 24 letters to be drawn. To assure that all entries have a theoretical possibility to win a race, each set of identification symbols must be mutually exclusive of all other entries in a given race. Further, it may be appreciated that each set does not contain the same letter more than 3 times to reduce the possibility of exaggerated movements in the visual display.

As previously mentioned, calculation of the incremental value ($I_x$) for each object is a function of the set of identification symbols, the sequence of letters drawn from the symbol generator and the first equation. In this particular embodiment, the first equation for the incremental value ($I_x$) is set forth as:

$$I_x=(L)\ (0.10+0.01(S))$$

where,

L=the numerical value assigned the drawn letter (i.e., calculated from each move value); and S=the sequence number of the letter drawn.

Accordingly, for the object bearing the name "JUNKET QUEEN" in the present example, if the letter "U" were the third letter drawn by symbol generator 14 in the sequence, the incremental value ($I_x$) would be calculated as follows:

$$I_3=(4)\ (0.10+0.01(3))=0.52 \text{ horse lengths}$$

The computer would then instruct the corresponding object indicator of "JUNKET QUEEN" to move 0.52 lengths relative to the remaining objects in the field, with the exception of the relative movements of other competing objects containing the letter "U" in their corresponding symbol sets.

In this example, the predetermined second equation for the position value ($M_x$) is preferably a simple summation of the sequence ($I_1, \ldots, I_x$) such that $M_x=I_1+I_2+\ldots I_x$. Hence, after the preferred twenty-four letter sequence draw of this game, the competing object with the highest numerical $M_{24}$ value would be deemed the winner of the ten entry field, the second highest would be the "place" finisher, and the third highest would be the "show" finisher.

In the preferred embodiment, the object indicators 16, 16' (FIG. 2) may be shown on a video display 21 or the like to indicate incremental movement of the field. Further, a sequence display 22 indicates the letter drawn and the sequence in which the random letters are drawn. FIG. 4 sets forth sample race results of ten races which indicates the Win (W), Place (P) and Show (S).

To promote competitiveness, an additional predetermined move value may be added to the position value ($M_x$) of the last place horse (where the maximum move is less than one (1) horse length) if a letter is drawn which does not occur in the field.

EXAMPLE 2

The second example is a stock market game incorporating the concept of the present invention which incrementally adjusts or accrues earnings of the stocks (i.e., the competing objects 11, 11') based upon the three letters designating a particular stock, and on the random draw of letters through random symbol generator 14 (FIG. 1).

As shown in FIG. 6, the game preferably includes one hundred (100) stocks each of which are in play during the course of the game. Each stock or competing object 11, 11' is identified by a unique three letter symbol set combination (i.e., the name of the stock).

In a brief overview, upon a participant entering the market or game by placing a bet, shares in one of the one hundred competing stocks, preferably through random designation, is issued to that participant. A participant may enter the game at any time during the course of play. If a predetermined condition or set of conditions are met during that iteration or bet by a participant, to be described below, symbol generator 14 will randomly generate one of the twenty-six letters of the alphabet. All stocks including this random generated letter in its assigned symbol set will be distributed earnings in an amount equivalent to the incremental value ($I_x$) for that object. This incremental value increases the overall value (i.e., the position value ($M_x$)) of all stocks having that letter in its symbol set. Preferably, the predetermined second equation for ($M_x$) is the summation of the sequence of incremental values ($I_1, \ldots, I_x$) for a particular stock in which its identification symbols are randomly drawn. Essentially, this is merely the summation of the earnings distributions to those three letters contained in a stock.

After a predetermined number of iterations, preferably one thousand (1000) bets, a random "jackpot" stock or stocks will be chosen. Those participants holding shares of the "jackpot" stock or stocks will be entitled to the earnings accrued based upon the total earnings distributions to those three letters contained in the "jackpot" stock after the thousandth iteration, the number of shares issued in that stock, and upon the number of shares owned by that participant.

Figure 5:
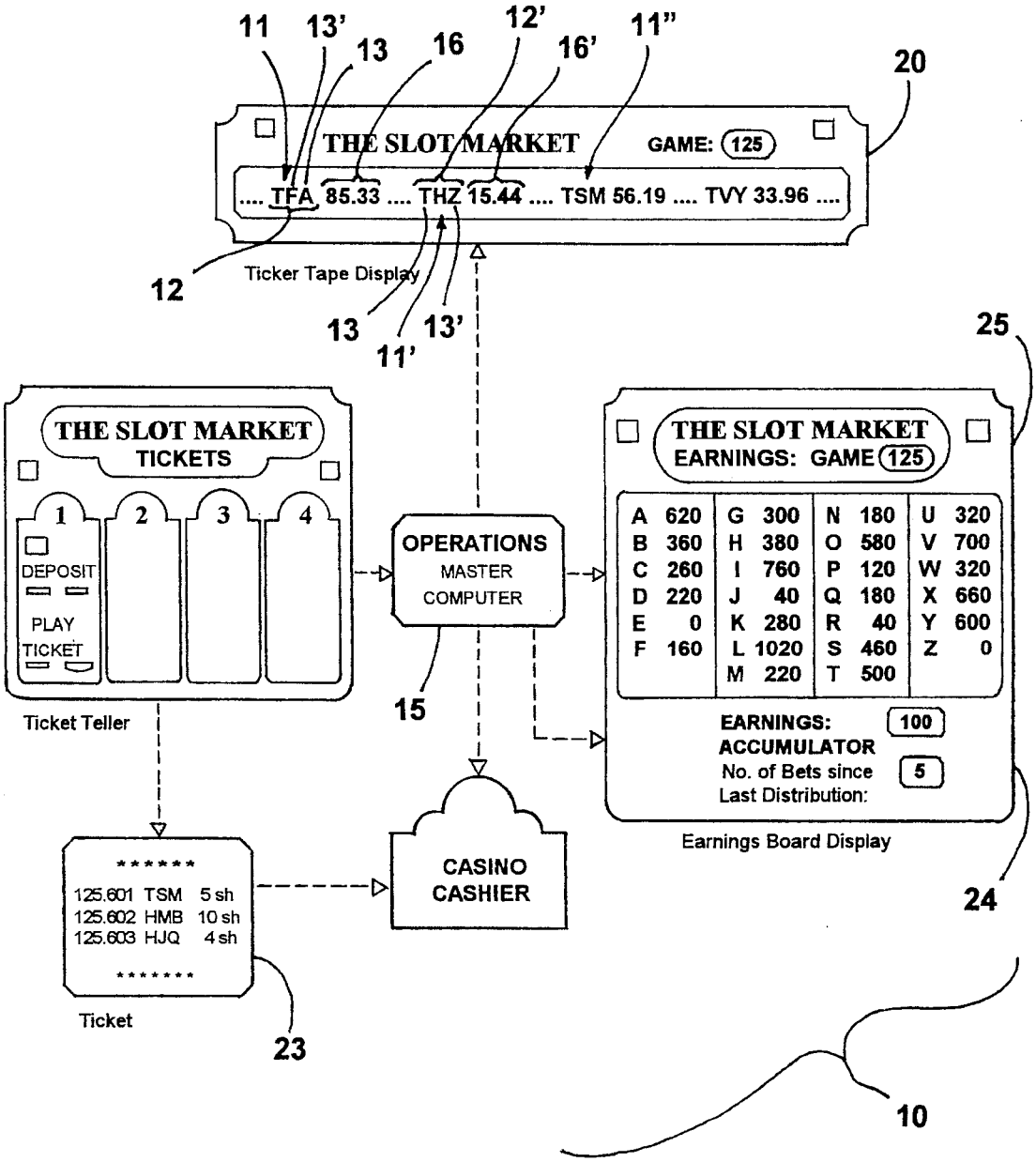
FIG. 5 is a schematic diagram of a display board for a stock market game embodiment incorporating the concept of the present invention.

To further explain the concepts of this particular embodiment of the present invention, attention is now directed to FIGS. 5, 7 and 8. Here, a participant places three bets at $2.00 a piece at a network terminal, and is randomly issued five (5) shares of TSM, ten (10) shares of HMB and four (4) shares of HJQ, as indicated by ticket 23. The random number of shares issued are preferably between about 2–10 shares of stock.

Based upon a predetermined probability establishing a house margin (as set by the casino), computer device 15 will randomly determine whether an earnings distribution is to occur at all (to be discussed below) during these three iterations (i.e., one iteration per $2.00 bet). In the event no distribution occurs, a predetermined earnings amount for each iteration will accumulate in an earnings accumulator 24 (FIG. 5) until the computer randomly determines a distribution is to occur.

In the preferred embodiment of this game, the predetermined earnings amount is twenty (20) dollars. Hence, as shown in FIG. 5, after five consecutive iterations in which no distribution has occurred, should the sixth iteration result in a distribution, then the accumulated $100 worth of earnings would be distributed.

Upon the computer randomly determining a distribution is to occur (for example at game number 125), during this sixth consecutive iteration, computer device 15 instructs symbol generator 14 to randomly generate one symbol from the list of symbols (i.e., the alphabet). This generated identification symbol determines which stocks will receive this earnings distribution of $100.

Accordingly, if the letter "S" were randomly drawn, all stocks containing the letter "S" would receive the accumulated earnings in the accumulator 24. As shown in FIG. 6, eleven (11) stocks (i.e., numbered stocks (2, 69, 72–75, 78, 86, 92, 96 and 99)) are provided in the list of one hundred stocks which include the letter "S" in its symbol set.

Briefly, it will be appreciated that the symbols (or letters) contained in the competing one hundred stocks, and associated symbol sets, have been evenly distributed through out the symbol sets such that a particular symbol is only included in up to eleven (11) or twelve (12) different stocks. Further, no two symbols are common in any symbol set, and no symbols are repeated in any one symbol set.

Hence, the predetermined first equation to calculate the incremental value ($I_x$) for the symbol set "TSM", and thus the other remaining ten stocks having the letter "S" in its symbol set, would be represented by:

$$I_x=(N\cdot X)$$

where,

N=the number of iterations (predetermined or randomly selected) for an earnings distribution by the computer since the last distribution; and X=the earnings amount distributed per iteration, excluding the distribution turn.

Accordingly, the incremental value ($I_x$) is equivalent to the amount displayed in the earnings accumulator display 24. For all stocks containing the letter "S" in their symbol set, in the above example where the computer draws a distribution marker on the sixth iteration, and the letter "S" is randomly generated, the incremental value will be $I_{125}$=(5·$20)=$100.

Once the earnings distribution occurs, which is cumulatively stored per letter as shown in the earnings board display 25 in FIG. 5, the earnings accumulation for symbol "S" will equal $460=$100+$360 (the previous earnings accumulated for symbol "S").

As set forth above, in this example, the predetermined second equation to calculate the position value ($M_x$) is preferably a simple summation of the sequence ($_1$, . . . , $I_x$) such that $M_x=I_1+I_2+\ldots I_x$. In essence, however, the position value or stock value is equivalent to the total value of the sum of the earnings accumulation of each symbol contained in the unique symbol set. For example, after the new earnings distribution at game 125, the position value ($M_x$) for stock "TSM" is equivalent to the earnings accumulation value accrued for T+S+M=$500+$460+$220=$1180. Similarly, the current stock value of stocks "HMB" and "HJQ", as determined from earnings board display 25, are $960 and $600, respectively.

After the preferred one thousandth (1000th) iteration (or bets placed) the last stock randomly chosen and issued (i.e., the "jackpot" stock) by computer device 15 is declared the winner whereby all shareholders of that stock will be entitled to a split of the earnings. Further, on the one thousandth (1000th) iteration, a random letter may be generated to distribute any undistributed accumulated earnings.

As set forth in FIG. 8, a summary of a simulated game is shown where the highlighted stock identified by "TSM" (No. 78) was the "jackpot" stock randomly chosen for the one thousandth iteration. Hence, the position value ($M_x=I_1+I_2+\ldots I_{1000}$) or stock value can be calculated from the table of FIG. 7. As mentioned, after the earnings distribution for the one thousandth (1000th) iteration, the position value ($M_x$) of stock "TSM" is equivalent to the earnings accumulation value accrued for T+S+M=$1640+$540+$220=$2400. Since thirty-five (35) shares were randomly issued by computer device 15 (FIG. 8), each share has a share value of 2400/35=$68.57. Accordingly, the Participant owning ticket 23, which was issued five (5) shares of stock "TSM" would be entitled to collect $342.85.

As a further incentive to participate, it should be noted that in the preceding example and in the preferred embodiment of this game, the casino or "House" is also at risk and the participants may potentially win an amount (as provided by the House) greater than the actual amount bet by the participants.

Preferably, the object indicators 16, 16' (FIG. 5) would be in the form of a video display such as the ticker tape display 20 in which the stock share values are continuously updated. The share value is the current stock value divided by the current total number of issued shares.

In the preferred embodiment of the stock market game, the random determination of the stock, number of shares and earnings distribution will be as follows. Upon a participant placing a bet, computer device 15 generates a random number of at least four digits. The first two digits (i.e., 00–99) will determine the particular stock distributed as corresponding to the numbered stocks (00–99) in FIG. 6.

Further, the third digit determines the number of shares of stock distributed for the stock determined by the first two digits. This distribution is as follows:

| Third digit | Number of Shares |
|---|---|
| 0, 1, 2 | two shares |
| 3, 4, 5 | three shares |
| 6 | four shares |
| 7 | five shares |
| 8 | six shares |
| 9 | ten shares |

The forth digit of the four digit random number determines whether an earnings distribution is to occur or not, and is in accord with the preferred following formula:

| Fourth digit | |
|---|---|
| 0–7 | If 0–7 is randomly drawn, no earnings distribution is to occur, and the $20 earnings per bet will be accumulated in the earnings accumulator. |
| 8 or 9 | An earnings distribution occurs distributing all earnings accumulated in the earnings accumulator, and no earnings occur for the current iteration. |

In the event an eight (8) or a nine (9) is randomly drawn as the fourth digit, the computer will instruct the symbol generator to randomly draw a symbol to determine where the distribution is to occur.

With networked play, it is estimated that the duration of each game will be about fifteen (15) minutes since the winner or winners will not be determined until after the preferred one thousand iteration. Further, once the participant places a bet, the participant need not be directing full attention to the play of this game, and can participate in other related games to the present invention or conventional forms of gambling. In this regards, this specific embodiment of the present invention is similar to KENO. Moreover, this game is particularly suitable for networking where individual betting terminals and displays can be located throughout a casino or at participating casinos.

As set forth by the above two examples, a wide variety of casino oriented gambling games can be created using the core concept of the present invention. Moreover, the present invention is very suitable for pari-mutuel style betting, since play of the game may be offered through network terminals distributed through one or more participating casinos.

As is apparent from the description of the present invention and preceding examples, a method is provided for determining the play of a gaming apparatus having at least two competing objects wherein a game is played by positioning the objects in competition as a function of numbers associated with each competing object. The method comprises the steps of: (A) assigning to each object 11, 11' an associated unique set of identification symbols 13, 13'; (B) generating, by the symbol generator 14, a random sequence of at least two (2) of the symbols from the associated unique sets of the identification symbols; and (C) calculating with the computer device 15 an incremental value ($I_x$) for each object based on each identification symbol drawn in the random sequence of step (B). Each incremental value ($I_x$) for each object being a function of the identification symbols contained in the respective associated set, and determining an independent incremental progression of play of each respective object. The next step of the present invention includes (D) computing with the computer device 15 a position value ($M_x$) for each object based on each symbol drawn in the random sequence of step (b) as a function of the respective incremental value ($I_x$) to determine a competing game position relative to any other object; and (E) changing an object indicator 16, 16' for each object a proportional amount corresponding to the relative position value ($M_x$) thereof.

The method further includes, after step (A), storing each set of symbols in a storage device 27 (FIG. 1) coupled to computer device 15. Further, after step (C), storing each incremental value ($I_x$) in storage device 27. The method preferably also includes repeating steps (B)–(E) until at least one position value ($M_x$) surpasses a threshold ($M_t$) to determine the winner.

In an alternative method, steps (B)–(E) are repeated a predetermined number (n) of times.

What is claimed is:

1. A gaming apparatus wherein a game is played by positioning at least two objects in competition as a function of numbers based on letters associated with each object, said gaming apparatus comprising:

at least two competing objects each identified by an object name consisting of a unique combination of at least two letters from the alphabet;

a random letter generator generating a random sequence of letters from the alphabet;

a calculating device calculating an independent incremental value ($I_x$) for each object, to determine an independent incremental progression of play for each of the respective competitive objects, upon each letter being randomly drawn in said random sequence, the relative magnitude of each said incremental value for each object being a function of the letter drawn and the inclusion of that respective letter in any of the respective object names corresponding to the respective competitive objects, said calculating device further computing a position value ($M_x$) for each object during each random letter generation as a function of the respective incremental value ($I_x$) to determine a competing game position relative to any other object; and an object indicator for each said object coupled to said calculating device to indicate the relative corresponding position value ($M_x$) thereof.

2. The gaming apparatus as defined by claim 1 wherein, said letter generator is coupled to said calculating device.

3. The gaming apparatus as defined by claim 1 further including:

a storage device, coupled to said calculating device, for storing a sequence of incremental values ($I_1, \ldots, I_n$) for each object and corresponding to the sequence of generated letters to compute the respective position value ($M_n$).

4. The gaming apparatus as defined by claim 1 further including:

a storage device, coupled to said calculating device, for storing the respective position value ($M_x$) for each object.

5. The gaming apparatus as defined by claim 1 wherein, said respective position value ($M_x$) for each object is a function of a respective sequence of incremental values from incremental value ($I_1$) to said incremental value ($I_x$).

6. The gaming apparatus as defined by claim 1 further including:

a storage device, coupled to said calculating device, for storing said object names consisting of the unique combinations of letters.

7. The gaming apparatus as defined by claim 1 wherein, each said incremental value ($I_x$) is calculated in accordance with a first predetermined equation.

8. The gaming apparatus as defined by claim 1 wherein, each said incremental value ($I_x$) is calculated in accordance with a first predetermined equation based upon the sequence of said letters generated by said letter generator.

9. The gaming apparatus as defined by claim 7 wherein, each said position value ($M_x$) is calculated in accordance with a second predetermined equation incorporating at least $I_x$ of a sequence of incremental values from incremental value ($I_1$) to said incremental value ($I_x$) for each object corresponding to said random sequence of generated letters.

10. The gaming apparatus as defined by claim 1 further including:

a moving mechanism coupled to each said object indicator to independently and physically move each said object indicator a proportional amount corresponding to the respective incremental value ($I_x$).

11. The gaming apparatus as defined by claim 1 wherein, each said object indicator electronically displays the relative corresponding position value ($M_x$) of each object.

12. The gaming apparatus as defined by claim 11 wherein, each said object indicator is provided by a numerical display device.

13. The gaming apparatus as defined by claim 1 wherein, said gaming apparatus is a casino gambling gaming apparatus.

14. A method of determining the play of a gaming apparatus having a plurality of competing objects, and a random letter generator, said method comprising the steps of:

(A) selecting at least two competing objects, each identified by an object name consisting of a unique combination of at least two letters from the alphabet, from said plurality of competing objects wherein a game is played by positioning said objects in competition as a function of numbers based on the letters in the object name of the selected objects in competition;

(B) generating, by the letter generator, a random sequence of letters from the alphabet;

(C) calculating an independent incremental value ($I_x$) for each object, to determine an independent incremental progression of play for each of the respective competitive objects, upon each letter being randomly drawn in the random sequence of step (B), the relative magnitude of each said incremental value ($I_x$) for each object being a function of the letter drawn and the inclusion of that respective letter in any of the respective object names corresponding to the respective competitive objects;

(D) calculating a position value ($M_x$) for each object during each random letter generation of step (B) as a function of the respective incremental value ($I_x$) to determine a competing game position relative to any other object; and (E) changing an object indicator for each said object a proportional amount corresponding to the relative position value ($M_x$) thereof.

15. The method of claim 14 further including the step of:

after step (A), storing each said unique combination of letters in a storage device.

16. The method of claim 14 further including the step of:

after step (C), storing each said incremental value ($I_x$) in a storage device.

17. The method of claim 14 further including the step of:

(F) repeating steps (B)–(E) until at least one position value ($M_x$) surpasses a threshold ($M_t$).

18. The method of claim 14 further including the step of:

(G) repeating steps (B)–(E) a predetermined number (n) of times.

19. The method of claim 14 wherein, each said incremental value ($I_x$) is calculated in accordance with a first predetermined equation.

20. The method of claim 14 wherein, each said incremental value ($I_x$) is calculated in accordance with a first predetermined equation based upon the sequence of said letters generated by said letter generator.

21. The method of claim 19 wherein, each position value ($M_x$) is calculated in accordance with a second predetermined equation incorporating at least $I_x$ of a sequence of incremental values from incremental value ($I_1$) to said incremental value ($I_x$) for each object corresponding to said random sequence of generated letters.

22. The method of claim 14 wherein, said respective position value ($M_x$) for each object is a function of a respective sequence of incremental values from incremental value ($I_1$) to said incremental value ($I_x$).

* * * * *